US008365641B2

(12) United States Patent
Daglow

(10) Patent No.: US 8,365,641 B2
(45) Date of Patent: Feb. 5, 2013

(54) TORQUE WRENCH

(76) Inventor: Terry Daglow, Allen, TX (US)

( * ) Notice: Subject to any disclaimer, the term of this patent is extended or adjusted under 35 U.S.C. 154(b) by 0 days.

(21) Appl. No.: 13/105,251

(22) Filed: May 11, 2011

(65) Prior Publication Data

US 2011/0277601 A1 Nov. 17, 2011

Related U.S. Application Data

(60) Provisional application No. 61/333,753, filed on May 12, 2010.

(51) Int. Cl.
*B25B 23/157* (2006.01)
*B25B 23/142* (2006.01)
*B25B 23/159* (2006.01)
*B25B 23/14* (2006.01)

(52) U.S. Cl. ..... 81/476; 81/478; 81/467; 81/473; 81/480

(58) Field of Classification Search ..... 81/467–480
See application file for complete search history.

(56) References Cited

U.S. PATENT DOCUMENTS

| | | | | | |
|---|---|---|---|---|---|
| 40,726 | A * | 11/1863 | Mershon | 81/475 |
| 2,697,370 | A * | 12/1954 | Brooks | 81/58 |
| 4,238,978 | A | 12/1980 | Leone | |
| 4,384,622 | A | 5/1983 | Koziniak | |
| 6,334,377 | B1 | 1/2002 | Wu | |
| 7,197,968 | B2 * | 4/2007 | Bubel | 81/475 |
| 7,281,458 | B2 * | 10/2007 | Chuang | 81/475 |
| 7,762,164 | B2 | 7/2010 | Nino | |
| 7,967,683 | B2 * | 6/2011 | Chuang | 464/39 |
| 8,002,098 | B2 * | 8/2011 | Rahm | 192/56.61 |
| 8,104,383 | B2 * | 1/2012 | Lai | 81/475 |
| 2003/0083669 | A1 | 5/2003 | Gleason | |
| 2007/0209486 | A1 | 9/2007 | Gauthier et al. | |
| 2010/0275744 | A1 | 11/2010 | Wengreen | |
| 2010/0275745 | A1 | 11/2010 | Wengreen et al. | |
| 2010/0275746 | A1 | 11/2010 | Wengreen et al. | |
| 2010/0307299 | A1 | 12/2010 | Nino | |
| 2011/0056341 | A1 * | 3/2011 | Lai | 81/475 |

* cited by examiner

*Primary Examiner* — Bryan R Muller
(74) *Attorney, Agent, or Firm* — George M. Tompkins; Tompkins, P.C.

(57) ABSTRACT

A torque wrench comprising a shaft, a shaft cam configured to rotate with the shaft around the longitudinal axis, a groove defined in the shaft cam, a ramp positioned within the groove at a position below the groove upper surface, an outer cam comprising an engaging member configured to selectively contact a ramp upper surface or groove upper surface. The wrench also comprises a spring to apply a downward force on the outer cam and a void defined in the groove between the ramp and a side wall of the groove to allow the engaging member to escape the groove when not contrained by the ramp.

15 Claims, 10 Drawing Sheets

TORQUE WRENCH

CROSS REFERENCE TO RELATED APPLICATIONS

Applicant claims the benefit of U.S. Patent Application Ser. No. 61/333,753, filed May 12, 2010, which is hereby incorporated by reference.

TECHNICAL FIELD OF THE INVENTION

The present invention is generally directed towards a torque wrench of a type that may be used for securing fasteners used in medical devices.

BACKGROUND ART OF THE INVENTION

Implantable medical devices frequently use set screws to secure a catheter into an electrical and/or non-electrical connection system to deliver a medical treatment therapy, i.e. pacemakers, defibrillator and neurostimulators. A torque wrench is used to engage and tighten this set screw. The torque wrench has a predetermined torque limit that prevents the set screw from damaging the catheter or medical device, rendering them unusable or un-removable.

While the torque wrenches that are currently used have limited tightening torque, they are not torque limited in the reverse (screw removal) direction. As a result, the wrench may accidentally apply a reverse torque as it is disengaged from the set screw and the set screw can become loosened, potentially causing a loss of electrical conduction or other malfunction of the medical device. Additionally, prior art torque wrenches do not have any indicator showing whether the wrench has been used to tighten a fastener to the prescribed torque.

SUMMARY

Problems with prior art torque wrenches are overcome by providing a torque wrench comprising a shaft with a longitudinal axis; wherein the shaft has a lower end and an upper end, the lower end being configured to engage a fastener; a shaft cam configured to rotate with the shaft around the longitudinal axis; a groove defined in the shaft cam, the groove comprising a groove upper surface; a ramp positioned within the groove at a position below the groove upper surface, wherein the ramp comprises a ramp upper surface with a first lower point, a first upper point and a surface extending along a perimeter of the shaft cam between the first lower and first upper points at an angle with respect to the longitudinal axis; the ramp upper surface is configured so that the first lower point is positioned in the direction opposite of the direction of the intended torque with respect to the first upper point; a housing surrounding the shaft and shaft cam; an outer cam comprising an engaging member extending within the housing, wherein the engaging member is configured to selectively contact ramp upper surface or groove upper surface; a spring configured to apply a downward force on the outer cam, such that the outer cam tends to prevent the shaft cam from rotating when the upper surface of the ramp is in contact with the engaging member of the outer cam; and a void defined in the groove between the ramp and a side wall of the groove, the void configured to allow the engaging member to escape the groove when it is not constrained by the ramp.

In one embodiment, the torque wrench also comprises an upper end cap attached to the housing and configured to contain the spring; and a lower end cap attached to the housing; wherein a hole is defined in the lower end cap to allow the shaft to extend through the lower end cap.

In another embodiment, the torque wrench also comprises a washer positioned between the spring and the outer cam.

In a another embodiment, the groove upper surface comprises a second lower point, a second upper point, and a surface extending between the second lower and second upper points along a perimeter of the shaft cam at an angle with respect to the longitudinal axis, and wherein the upper groove surface is configured so that the second lower point is positioned in the direction of the intended torque with respect to the second upper point.

In another embodiment, the groove upper surface is at an angle between 10 and 80 degrees with respect to the longitudinal axis.

In another embodiment, the groove upper surface is at an angle between 60 and 80 degrees with respect to the longitudinal axis.

In another embodiment, the ramp upper surface is at an angle between 10 and 80 degrees with respect to the longitudinal axis.

In another embodiment, the ramp upper surface is at an angle between 60 and 80 degrees with respect to the longitudinal axis.

In another embodiment, a line between the first upper point and the first lower point is an angle between 10 and 80 degrees with respect to the longitudinal axis.

In another embodiment, a line between the first upper point and the first lower point is an angle between 60 and 80 degrees with respect to the longitudinal axis.

In another embodiment, a line between the second lower point and the second upper point is at an angle between 10 and 80 degrees with respect to the longitudinal axis.

In another embodiment, a line between the second lower point and the second upper point is at an angle between 60 and 80 degrees with respect to the longitudinal axis.

BRIEF DESCRIPTION OF THE DRAWINGS

For a more complete understanding of the present invention and for further advantages thereof, reference is now made to the following Description of the Preferred Embodiments taken in conjunction with the accompanying Drawings in which.

DETAILED DESCRIPTION OF THE PREFERRED EMBODIMENTS

Figure 1:
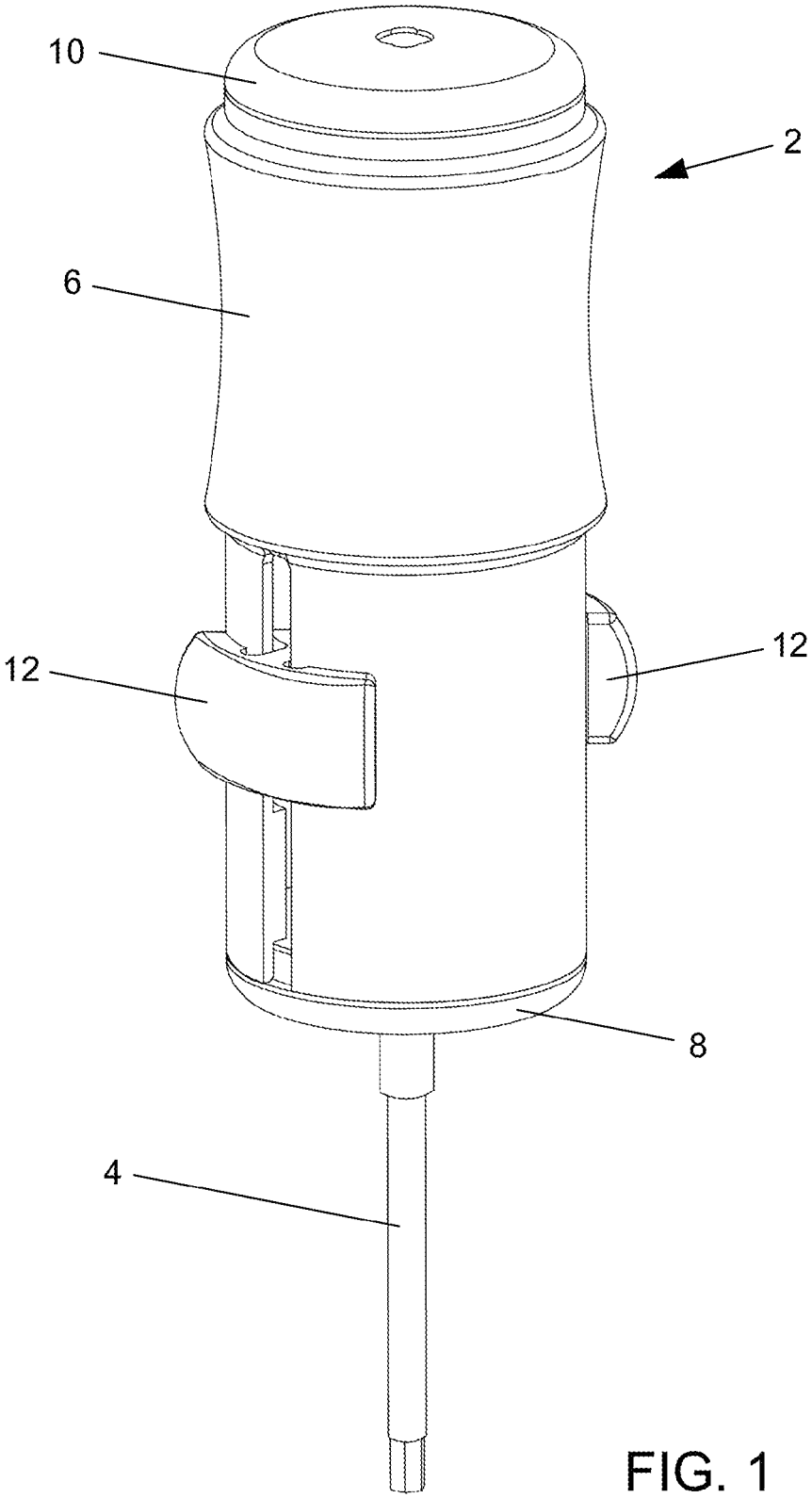
FIG. 1 is a view of a torque wrench.

Referring to FIG. 1, a wrench 2 is shown which is configured to limit torque applied to a threaded fastener (not shown) in a first rotational direction and to prevent force from being applied to the fastener in a second rotational direction. Wrench 2 is configured to indicate when it has been used to tighten a fastener to a designated torque and is configured to be resettable back to its original condition. Wrench 2 is particularly useful with respect to implantable medical devices, but may be used in other applications where torque limitations are necessary.

Figure 2:
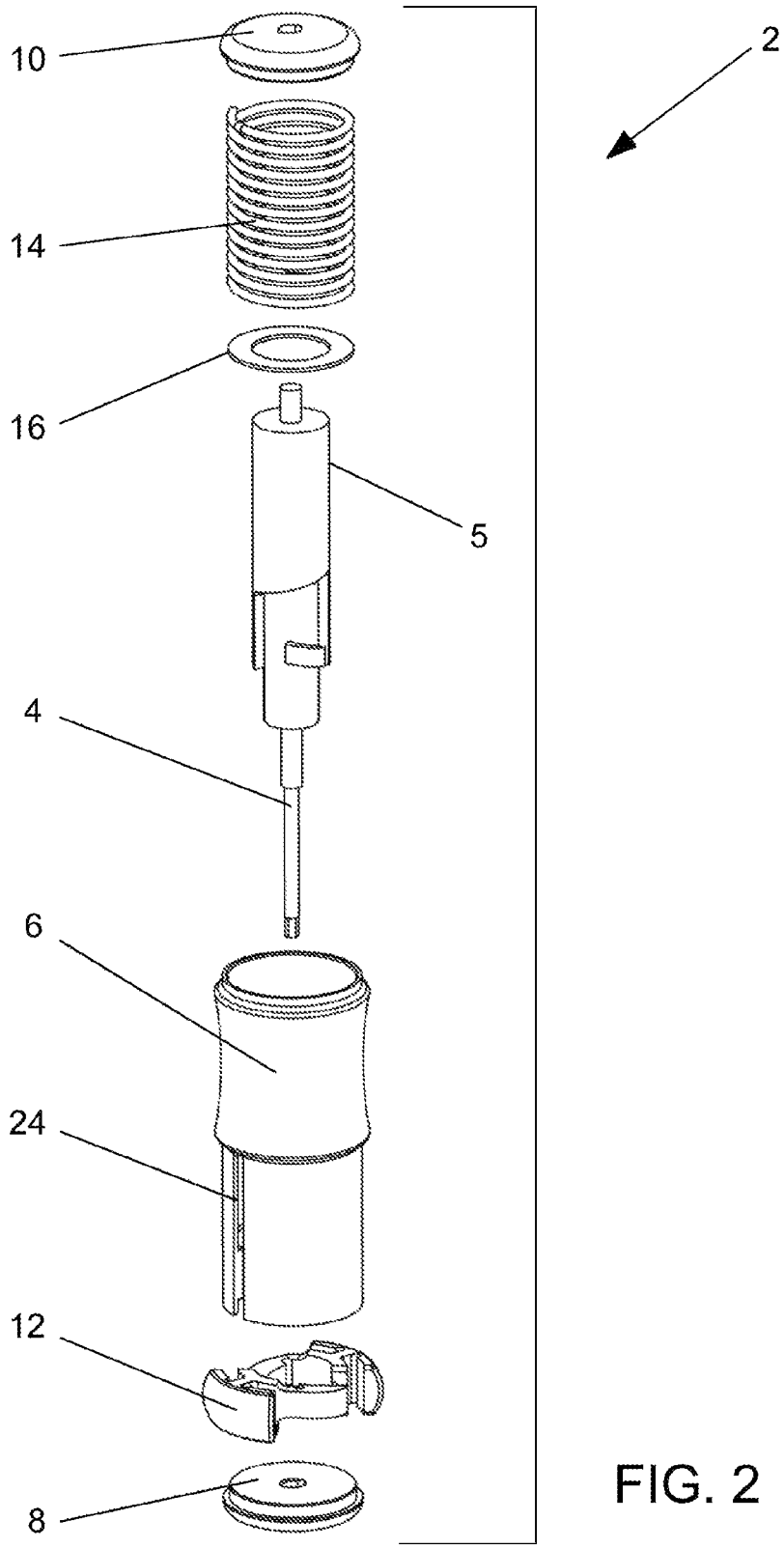
FIG. 2 is an exploded view of a torque wrench.

Referring to FIG. 2, wrench 2 comprises shaft 4, which is preferably configured to engage and transmit a torque to a fastener, such as a hex-head set screw. Shaft 4 comprises a hard and tough material such as stainless steel. A cam 5 is attached to shaft 4. A housing 6 is configured to contain the components of wrench 2 and to provide a location for the user to place his or her fingers in an area best suited to enable rotation and transmission of torque. An outer cam 12 slides within housing grooves 24 defined in housing 6.

Wrench 2 also comprises a spring 14 which is configured to provide a force on outer cam 12. Spring 14 preferably comprises comprise a compression spring (shown), comprising steel. Alternatively, a wave washer, Belleville washer or a compressible polymer (e.g. silicone rubber) may be used. Washer 16 is positioned between spring 14 and outer cam 12. Washer 16 is configured to be centered in housing 6, providing a platform for spring 14 to rest. An upper end cap 10 is configured to position shaft 4 in the center of housing 6. Wrench 2 also comprises lower end cap 8. Lower end cap 8, when inserted into the slotted end of housing 6, retains outer cam 12. Except as otherwise indicated, all parts may comprise plastic, ceramic, or metal. Plastic is preferred because it is inexpensive and easy to manufacture.

To assemble wrench 2, outer cam 12 is inserted into housing grooves 24. Then, lower end cap 8 is attached to housing 6 via laser welding, ultrasonic welding, gluing, swaging, crimping or the like. Next, shaft 4, with cam 5 attached, is inserted through lower end cap 8, outer cam 12 and housing 6. Washer 16 is inserted over shaft 4 and into housing 6. Spring 14 is inserted over shaft 4 and into housing 6. An upper end cap 10 is placed over shaft 4 and housing 6, thereby compressing spring 14. Upper end cap 10 is attached to housing 6 via laser welding, ultrasonic welding, gluing, swaging or crimping, or the like.

Figure 3:
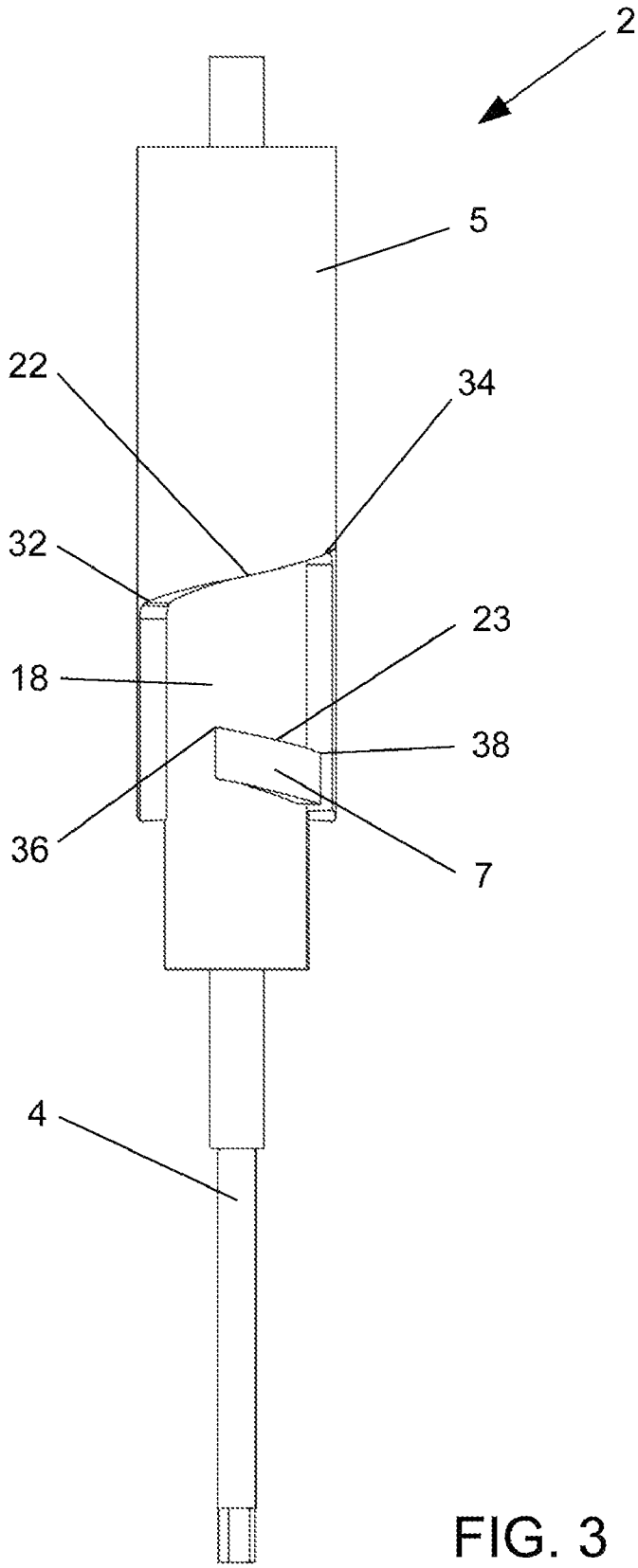
FIG. 3 is a view of a cam for a torque wrench.

FIG. 3 shows a larger view of shaft 4 and cam 5. Cam 5 is preferably a cylinder with one or more groove 18 defined in a portion of the cylinder wall. Cam 5 is preferably permanently attached to shaft 4, e.g., by gluing. An upper end of groove 18 preferably comprises an angled surface 22. Angled surface 22 preferably extends between a first lower point 32 and a first upper point 34. First lower point 32 is positioned before first upper point 34 with respect to the angular direction of intended torque. Angled surface 22 may be at any angle with respect to a central axis of shaft 4, but is preferably at an angle between 10 and 85 degrees and most preferably between 60 and 80 degrees. Although angled surface 22 is shown as a planar surface, other configurations may be used, such as an arch or a surface with multiple slopes.

Cam 5 also comprises one or more ramp 7. Ramp 7 enables a linearly-directed force to be translated into a rotational-directed torque. Ramp 7 is preferably located near a lower end of groove 18. Ramp 7 includes an upper surface 23 which is angled with respect to the central axis of torque wrench 2. Ramp upper surface 23 preferably extends between a second upper point 36 and a second lower point 38. Although upper surface 23 is shown as a planar surface, other configurations may be used, such as an arch or a surface with multiple slopes. Ramp upper surface 23 is positioned before first upper point 34 with respect to the angular direction of intended torque. Ramp upper surface 23 may be at any angle with respect to a central axis of shaft 4, but is preferably at an angle between 10 and 85 degrees and most preferably between 60 and 80 degrees. Ramp 7 preferably does not completely close the bottom of groove 18, that is, a space is preferably defined between ramp 7 and a side of groove 18 which allows a cam engaging member (described below) to pass around ramp 7 out of groove 18.

Figure 4:
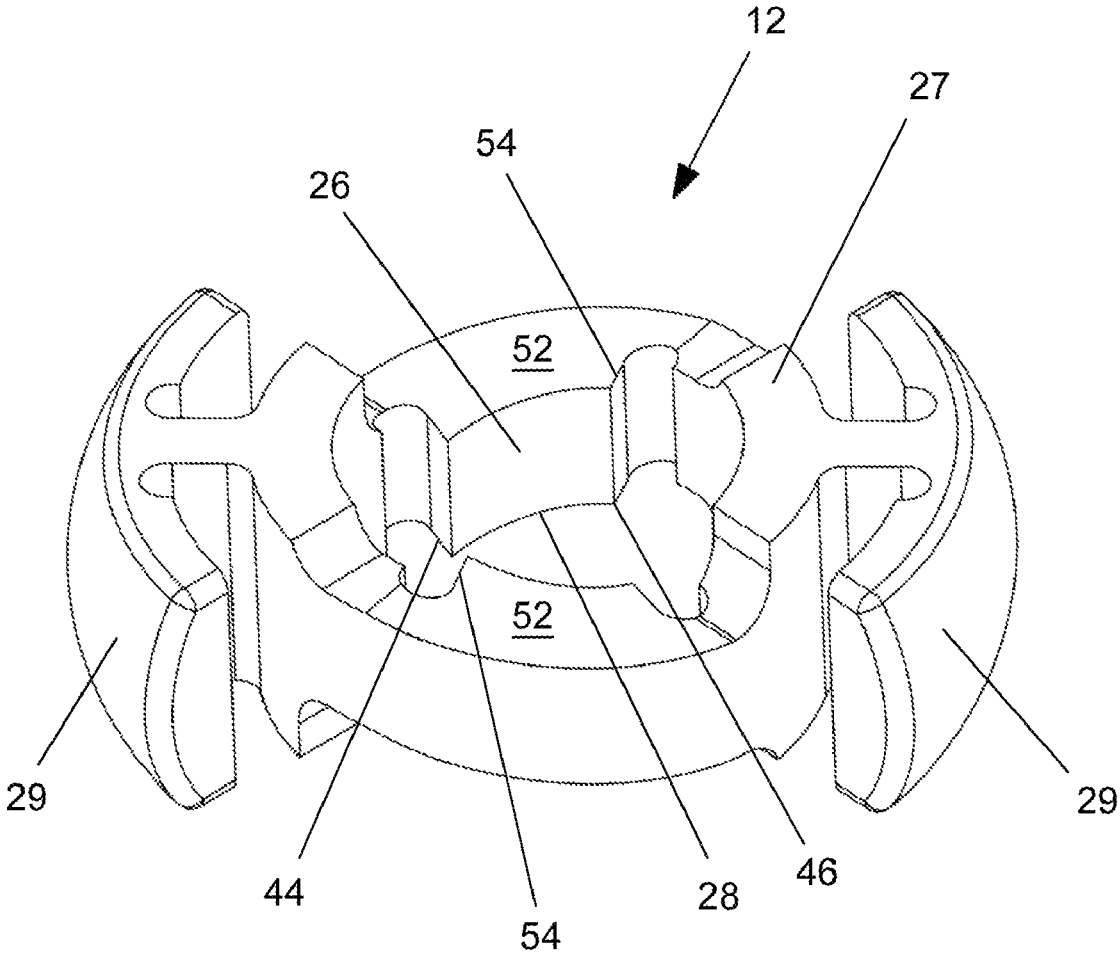
FIG. 4 is a view of an outer cam for a torque wrench.

FIG. 4 shows a larger view of outer cam 12. Outer cam 12 comprises cam engaging members 26 that are positioned within housing 6 and are preferably connected to an inner ring 27. Outer cam 12 also comprises outer ring 29, which is connected through housing grooves 24 to inner ring 27. Outer cam 12 may be comprised of metal, ceramic or plastic material. Cam engaging member 26 comprises cam engaging surface 28 which is configured to engage upper surface 23 of ramp 7, so that a rotational restraining torque is applied on inner cam 5 when a linear force is applied on outer cam 12. Cam engaging surface 28 is preferably configured with a slope equal to that of upper surface 23 of ramp 7, but may have a different slope or may be configured in a geometry with no slope, such as a cylinder. Alternatively, cam engaging surface 28 may have a slope as described above with respect to ramp upper surface 23 while ramp upper surface 23 is configured in a geometry with no slope, such as a cylinder. Cam engaging surface 28 preferably extends between a lower cam engagement point 44 and an upper cam engagement point 46. Although cam engaging surface 28 is shown as a planar surface, other configurations may be used, such as an arch or a surface with multiple slopes. Upper cam engagement point 46 is positioned before lower cam engagement point 44 with respect to the angular direction of intended torque. Outer cam 12 also comprises engaging member upper surface 52.

Figure 5A:
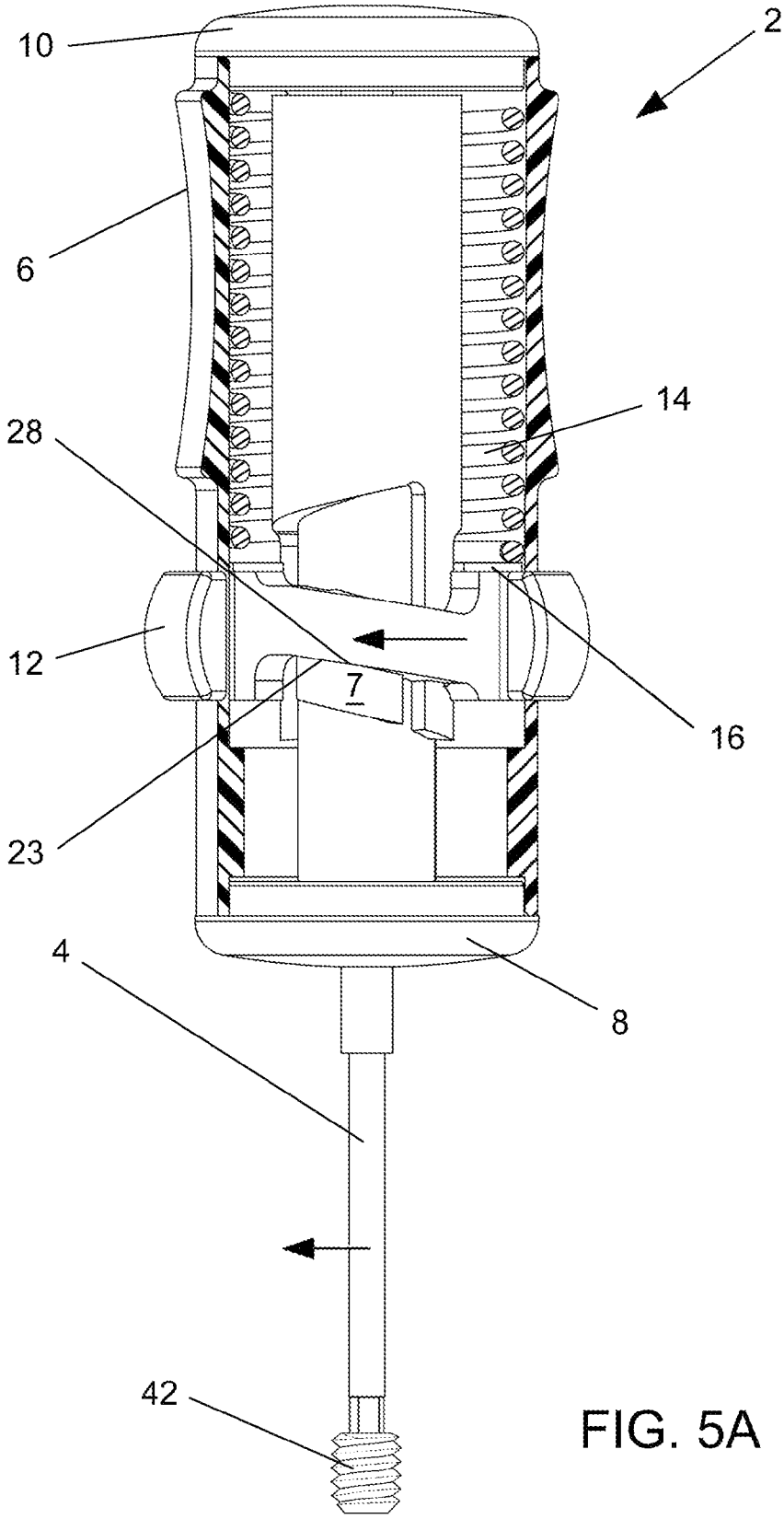
FIGS. 5A-5C are partial section views of a torque wrench at various stages of operation.

Referring to FIG. 5A, during use torque is applied to an engaged fastener 42 as torque wrench 2 is rotated clockwise (as viewed from above). When the engaged fastener encounters torsional resistance approaching the torque limit of torque wrench 2, upper surface 23 of ramp 7 begins to slip against cam engaging surface 28 of outer cam 12, causing spring 14 to further compress. Ramp 7 of shaft 4 will maintain contact with cam engaging member 26 of outer cam 12 over a predetermined rotation distance.

Figure 5B:
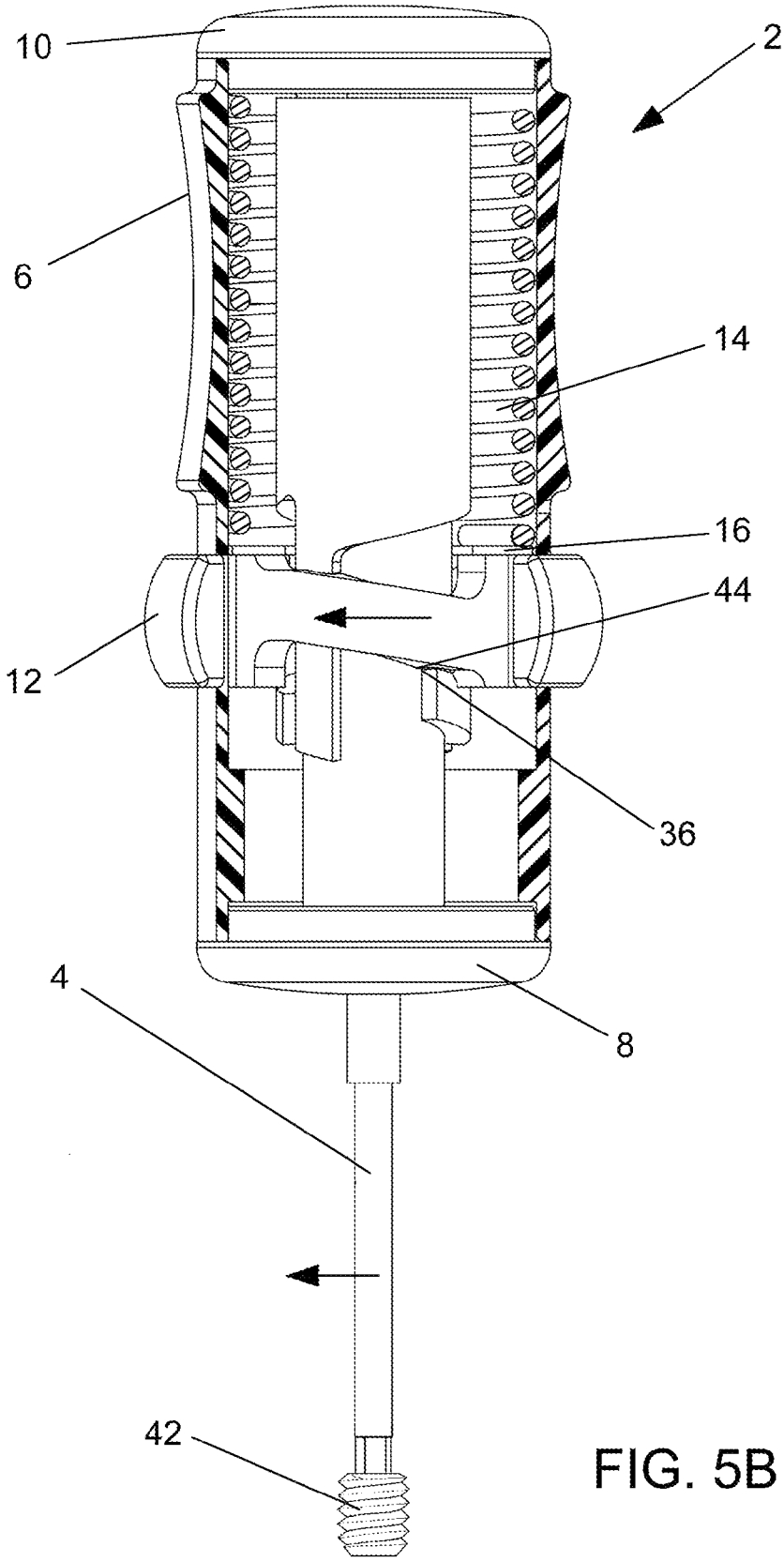
Figure 5C:
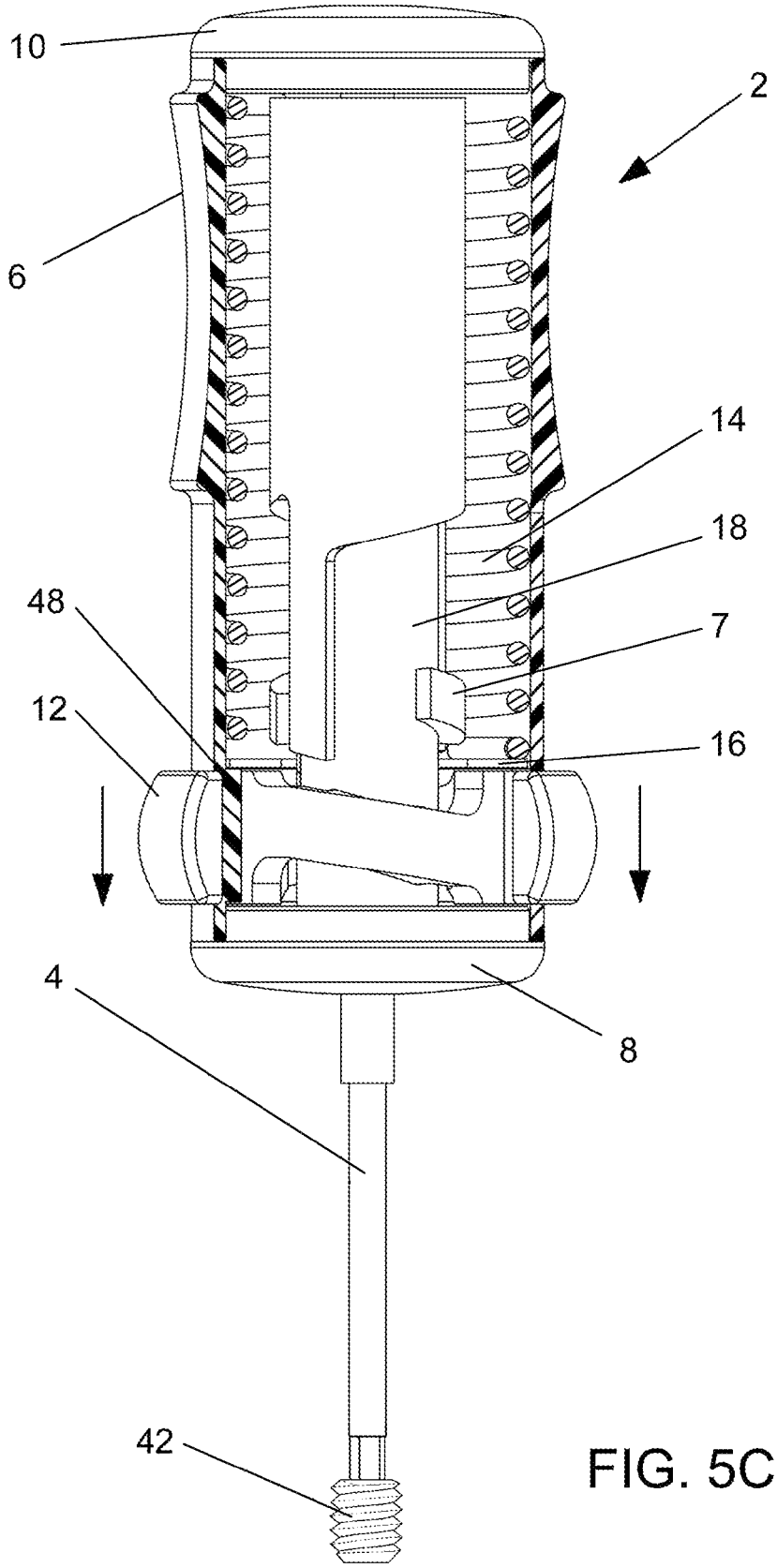

As shown in FIG. 5B, when the prescribed torque has been achieved, cam engaging member 26 will clear a crest of ramp 7, i.e., the lower cam engagement point 44 clears the first upper point 36. At this point, spring 14 is most compressed and exerts the greatest force on outer cam 12. The installed force of spring 14, along with the angles of ramp upper surface 23 and/or cam engaging surface 28 determines the torque delivered through shaft 4 to the engaged fastener. As shown in FIG. 5C, after cam engaging member 26 clears ramp 7, outer cam 12 is forced by spring 14 out of groove 18 to a substantially friction free location as washer 16 contacts a shoulder 48 of housing 6, removing the force of spring 14 from outer cam 12. When outer cam 12 is in this position cam 5 and shaft 4 rotate free from interference from outer cam 12. This position of outer cam 12 also indicates to the user that wrench 2 has been used to fully tighten a fastener.

Figure 6A:
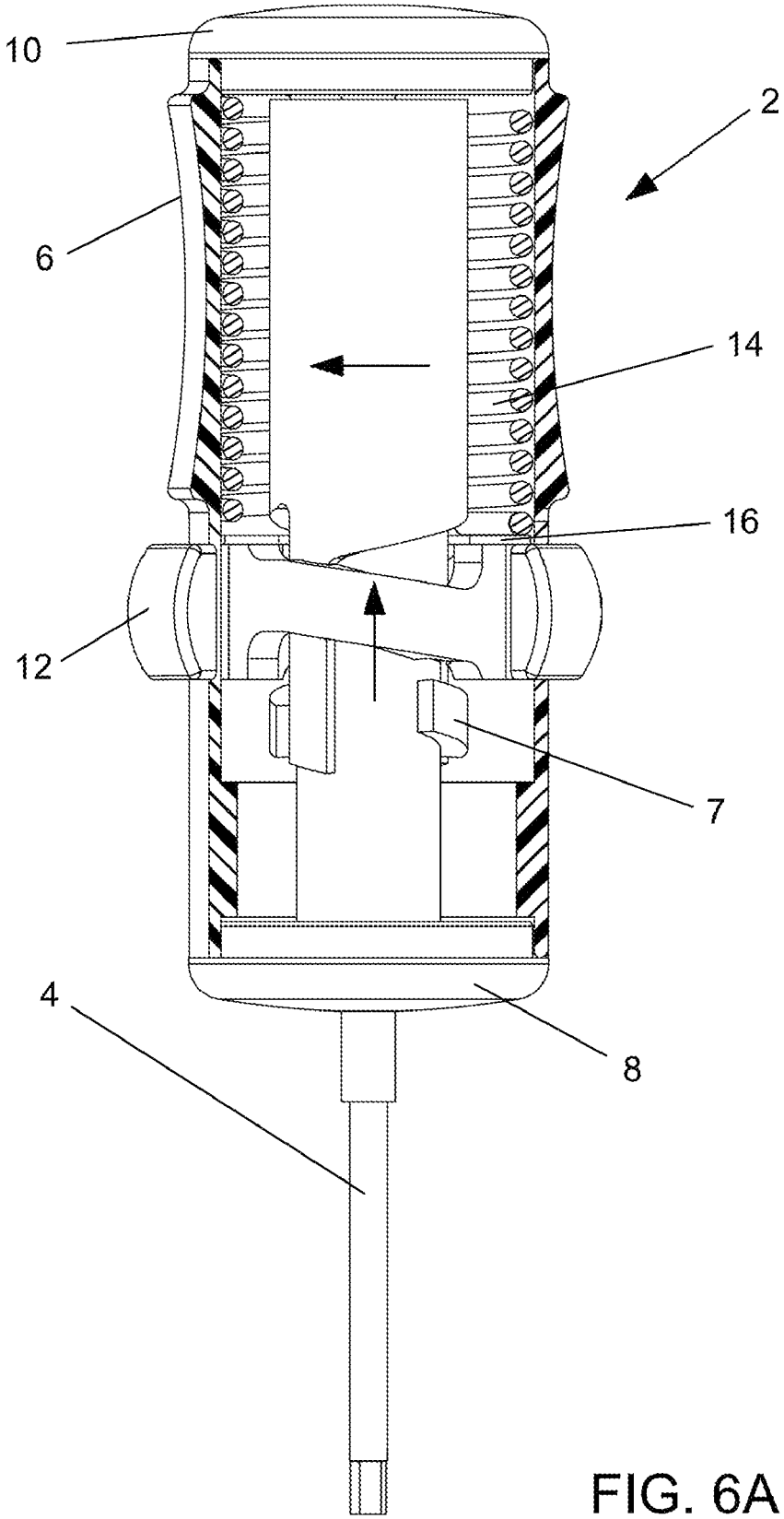
FIGS. 6A-6C are partial section views of a torque wrench at various stages of operation.
Figure 6B:
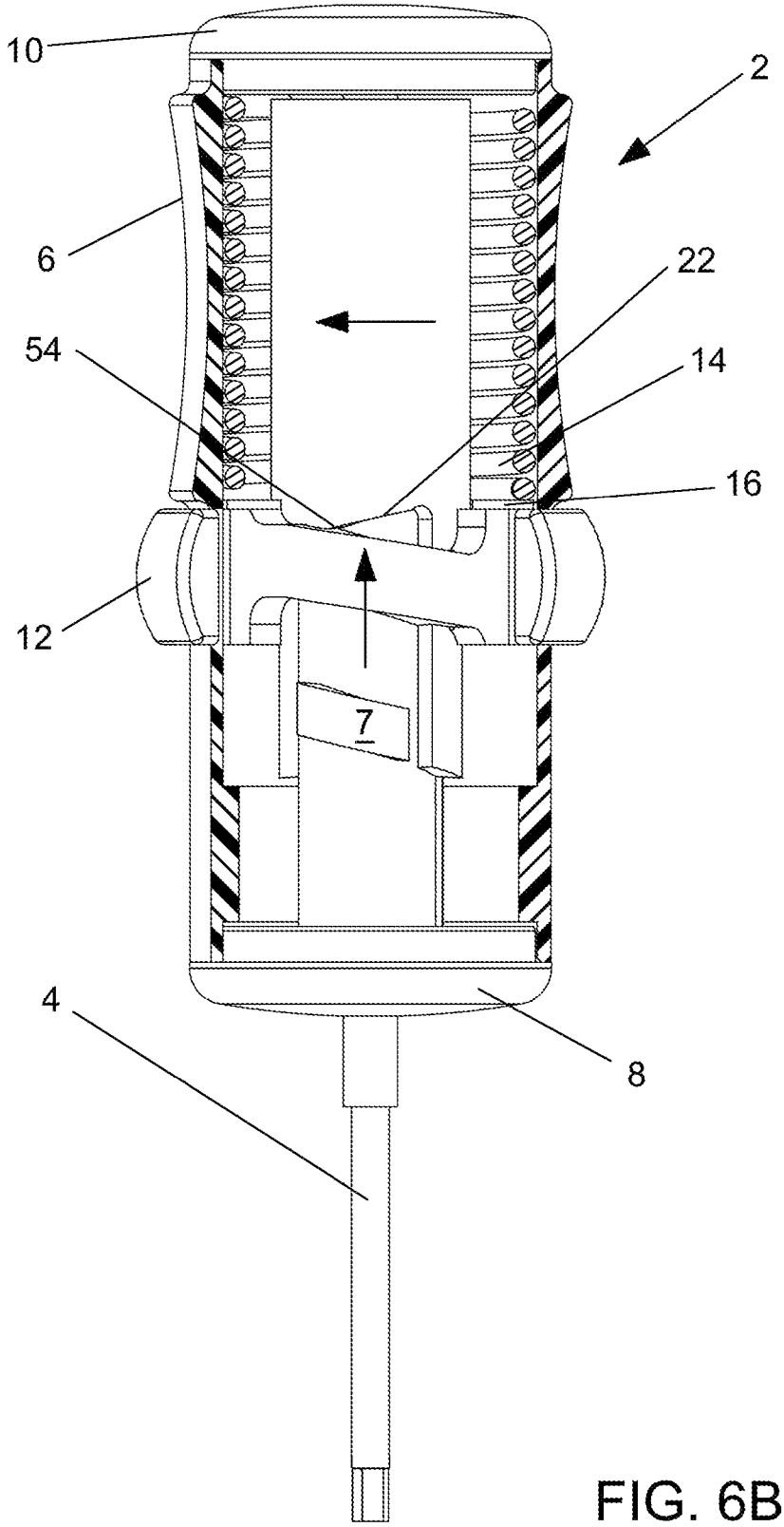
Figure 6C:
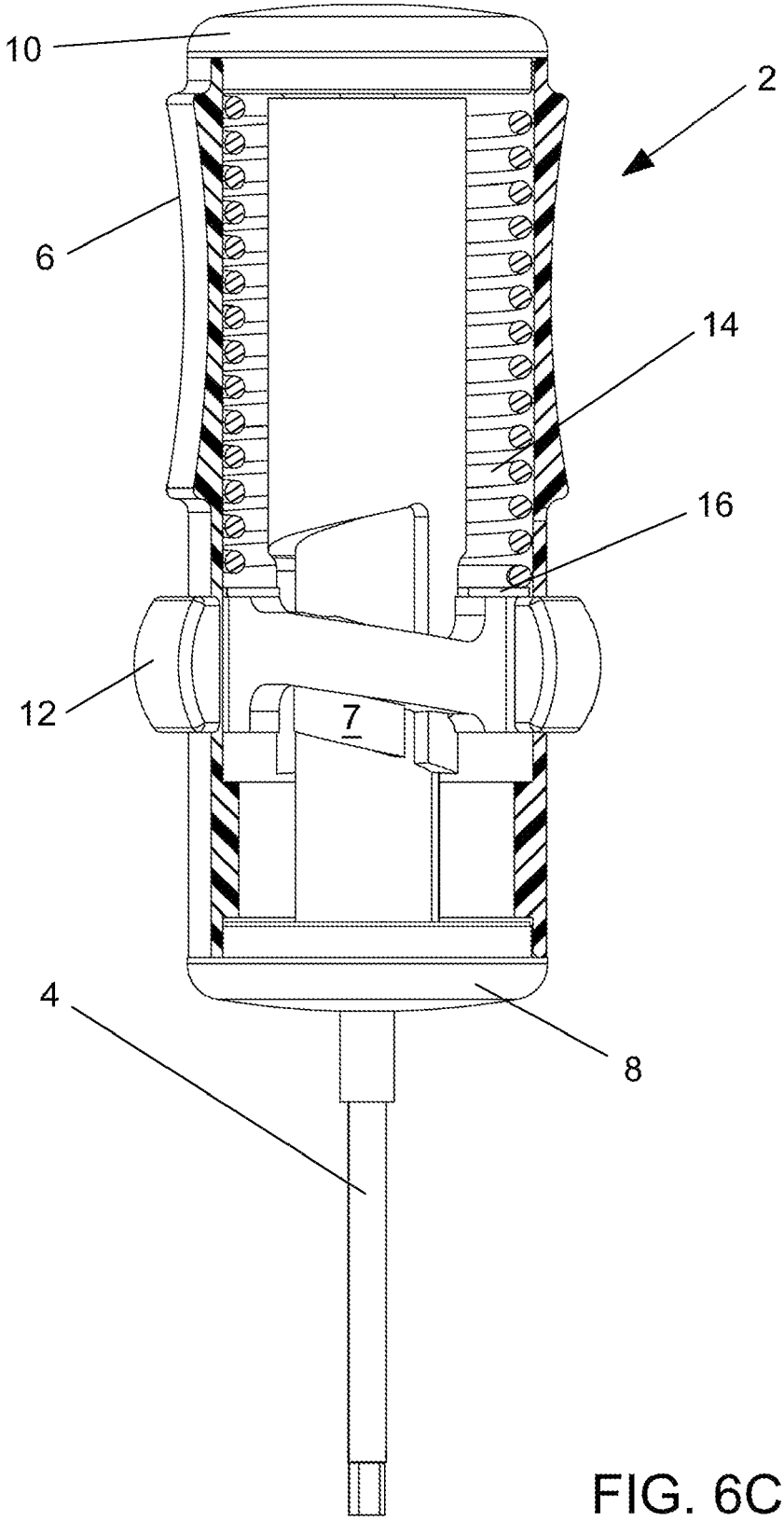

Referring to FIGS. 6A, 6B and 6C, outer cam 12 is configured to allow the user to re-engage the torque limiting mechanism to the original position. To reposition outer cam 12 to its original position, the user will disengage torque wrench 2 from the fastener, push outer cam 12 up housing grooves 24 until it stops, then release outer cam 12. As shown in FIG. 6B, as outer cam 12 is pushed up, upper shoulder 54 of cam engaging member 26 will be forced against angled surface 22 of cam 5, causing cam 5 and shaft 4 to rotate to their original position. As shown in FIG. 6C, removing the upward force (by letting go of outer cam 12) will allow outer cam 12 to move back to its original location, so that cam engaging member 26 is again in contact with ramp 7. The torque wrench 2 is ready for reuse.

Although the invention has been described with reference to specific embodiments, this description is not meant to be construed in a limiting sense. Various modifications of the disclosed embodiments, as well as alternative embodiments of the inventions, will become apparent to persons skilled in the art upon reference to the description of the invention. It is, therefore, contemplated that the appended claims will cover such modifications that fall within the scope of the invention.

I claim:

1. A torque wrench comprising:

a shaft with a longitudinal axis; wherein the shaft has a lower end and an upper end, the lower end being configured to engage a fastener;

a shaft cam configured to rotate with the shaft around the longitudinal axis;

a groove defined in the shaft cam by opposed side walls and an upper groove surface;

a ramp positioned within the groove between said side walls, wherein the ramp comprises a ramp upper surface spaced from the upper groove surface and having a first lower point, a first upper point and a surface extending along a perimeter of the shaft cam between the first lower and first upper points at an angle with respect to the longitudinal axis;

the ramp upper surface is configured so that the first upper point is positioned in the direction of the intended torque with respect to the first lower point;

a housing surrounding the shaft and shaft cam; wherein a housing groove is defined in the housing;

an outer cam comprising an engaging member extending within the housing, wherein the engaging member is configured to selectively contact the ramp upper surface;

a spring configured to apply a downward force on the outer cam, such that the engaging member applies a force against the ramp which tends to hinder the shaft cam from rotating with respect to the housing when the ramp upper surface is in contact with the engaging member of the outer cam; and a void defined in the groove between the ramp and a side wall of the groove, the void configured to allow the engaging member to escape the groove when it is not constrained by the ramp.

2. The torque wrench of claim 1 wherein said, the groove upper surface being angled with respect to the central axis and wherein the engaging member is configured to selectively engage groove upper surface.

3. The torque wrench of claim 1 further comprising:

an upper end cap attached to the housing and configured to contain the spring; and a lower end cap attached to the housing; wherein a hole is defined in the lower end cap to allow the shaft to extend through the lower end cap.

4. The torque wrench of claim 1 further comprising a washer positioned between the spring and the outer cam.

5. The torque wrench of claim 1 further wherein the groove upper surface comprises a second lower point, a second upper point, and a surface extending between the second lower and second upper points along a perimeter of the shaft cam at an angle with respect to the longitudinal axis, and wherein the groove upper surface is configured so that the second lower point is positioned in the direction of the intended torque with respect to the second upper point.

6. The torque wrench of claim 5 wherein the groove upper surface is at an angle between 10 and 80 degrees with respect to the longitudinal axis.

7. The torque wrench of claim 5 wherein the groove upper surface is at an angle between 60 and 80 degrees with respect to the longitudinal axis.

8. The torque wrench of claim 1 wherein the ramp upper surface is at an angle between 10 and 80 degrees with respect to the longitudinal axis.

9. The torque wrench of claim 1 wherein the ramp upper surface is at an angle between 60 and 80 degrees with respect to the longitudinal axis.

10. The torque wrench of claim 5 wherein a line between the first upper point and the first lower point is an angle between 10 and 80 degrees with respect to the longitudinal axis.

11. The torque wrench of claim 5 wherein a line between the first upper point and the first lower point is an angle between 60 and 80 degrees with respect to the longitudinal axis.

12. The torque wrench of claim 1 wherein a line between the second lower point and the second upper point is at an angle between 10 and 80 degrees with respect to the longitudinal axis.

13. The torque wrench of claim 1 wherein a line between the second lower point and the second upper point is at an angle between 60 and 80 degrees with respect to the longitudinal axis.

14. A torque wrench comprising:

a shaft with a longitudinal axis; wherein the shaft has a lower end and an upper end, the lower end being configured to engage a fastener;

a shaft cam configured to rotate with the shaft around the longitudinal axis;

a groove defined in the shaft cam by opposed side walls and an upper groove surface;

a ramp engaging member positioned in the groove between said side walls and spaced from said upper groove surface;

a housing surrounding the shaft and shaft cam;

an outer cam comprising a ramp, wherein the ramp comprises a ramp lower surface with a first lower point, a first upper point and a surface extending between the first lower and first upper points at an angle with respect to the longitudinal axis; the ramp lower surface is configured so that the first upper point is positioned in the direction of the intended torque with respect to the first lower point;

a spring configured to apply a downward force on the outer cam, such that the ramp engaging member applies a force against the ramp which tends to hinder the shaft cam from rotating with respect to the housing when the ramp lower surface is in contact with the ramp engaging member; and a void defined in the groove between the ramp engaging member and a side wall of the groove, the void configured to allow the ramp to escape the groove when it is not constrained by the ramp engaging member.

15. The torque wrench of claim 14 wherein a line between the first upper point and the first lower point is at an angle between 60 and 80 degrees with respect to the longitudinal axis.

* * * * *